United States Patent [19]

Cook et al.

[11] Patent Number: 4,521,839

[45] Date of Patent: Jun. 4, 1985

[54] STRIP LIGHTING SYSTEM

[76] Inventors: Brian A. Cook, 13316 Avenida La Valencia, Poway, Calif. 92064; Philip G. Quintin, 22 Carpenters Ct., Bodmin, Cornwall, England

[21] Appl. No.: 578,775

[22] Filed: Feb. 9, 1984

[51] Int. Cl.[3] ..... F21V 1/00

[52] U.S. Cl. ..... 362/238; 362/227; 362/234; 362/240; 362/249

[58] Field of Search ..... 362/227, 234, 237, 238, 362/240, 249

[56] References Cited

U.S. PATENT DOCUMENTS

| | | | |
|---|---|---|---|
| 3,633,023 | 1/1972 | Castiglioni | 362/249 |
| 3,755,663 | 8/1973 | George | 362/249 |
| 4,020,337 | 4/1977 | Chatten | 362/234 |
| 4,413,311 | 11/1983 | Orenstein | 362/249 |

*Primary Examiner*—Donald P. Walsh

*Attorney, Agent, or Firm*—Charmasson & Holz

[57] ABSTRACT

A strip lighting system comprising a string of electrically connected light bulbs contained within a flexible tube. The tube is of waterproof material and is sealed at each end by a removable plug, so that the string of bulbs can be removed when necessary to be repaired or replaced.

10 Claims, 7 Drawing Figures

STRIP LIGHTING SYSTEM

BACKGROUND OF THE INVENTION

The present invention relates to a Strip Lighting System in which a series of electric light bulbs are connected in a string and contained within a flexible tube.

Such a system is suitable for a variety of indoor and outdoor uses, both ornamental and practical. However, if the system is to be used outdoors it must be protected against damage from water and dirt. Also, there are problems in providing the desired flexibility while allowing the lamps to be replaceable if they fail.

In prior art strip lighting systems, such as those shown in U.S. Pat. No. 4,376,966 of Tieszen and U.S. Pat. No. 3,715,414 of Sternius, the lamps are permanently interconnected to each other and sealed within flexible tubes. In Sternius the system is ornamental and primarily intended for indoor use. In Tieszen the flexible tube is intended to be placed within a rigid channel which is then mounted on a wall.

SUMMARY OF THE INVENTION

It is a primary object of the invention to provide a strip lighting system which is substantially waterproof and suitable for a wide variety of indoor and outdoor uses.

It is a further object of the invention to provide a strip lighting system which is both economical and safe to use, and which is sturdy.

According to the present invention a strip lighting system is provided which comprises a flexible plastic tube, and a string of electrically connected light bulbs contained within the tube, each end of the tube being sealed by a removable plug.

The removable plug is of a waterproof material such as rubber. Thus the light bulbs are sealed within the tube, but can be removed and repaired or replaced when necessary.

Preferably, the light bulbs are electrically connected by a pair of wire leads extending along the string, and the leads project out of one of the plugs at one end of the tube for connection to an electrical power source. The bulbs can be relatively low power, so that the system can be run, for example, from a low power rechargeable battery. This makes the lighting system safe and relatively inexpensive to run.

According to another preferred feature of the invention, each light bulb is removably connected between the leads. Thus the light bulbs can be individually replaced if necessary. The light bulbs are preferably of the elongate type having an electrical contact at each end, and a pair of contact mountings is associated with each light bulb such that the bulb is seated between the mountings. The mountings are spring loaded against the bulbs contacts so that electrical connection is maintained during normal use of the system, but the bulbs can be manually released from their mountings when necessary. One mounting of each pair is electrically connected to one of the wire leads and the other mounting is electrically connected to the other lead.

In a preferred embodiment of the invention the contact mountings themselves comprise wire coil springs, with the light bulb contacts being seated within the coils of the respective springs. The springs may, for example, be seated in the bores of mounting cylinders to which the wire leads are bonded.

This type of mounting for the bulbs ensures that electrical contact is maintained even when the tube and string of bulbs is bent or flexed. Even if the cylinders are bent relative to the bulb mounted between them, contact between the spring coils and the bulb will normally be maintained. This type of mounting allows the bulbs to be replaced if they fail.

The strip lighting system is suitable for outdoor ornamental uses, and can be bent around corners of buildings while maintaining electrical connection between the lamps. It is sufficiently waterproof for underwater use. Other possible uses include illumination of large scale structures such as scaffolding, building sites, roadworks, and the like.

The lamps used are relatively low power and thus the system can be run off power rechargeable batteries. This makes the system economical enough for permanent low power illumination and safe for a wide variety of indoor and outdoor uses.

An alternative means of constructing the lighting string contained within the protective tubing is to utilize twin-lead cable which is supplied with a plasticized webbing between the parallel wires as both the conducting and mounting medium. In this embodiment a hole would be punched in the webbing at the location of the bulbs spaced along the wire and a metal bridge including a clip style bulb holder would be stamped onto the wire at either end of the hole providing both the electrical connections and the bulb mounting means.

BRIEF DESCRIPTION OF THE DRAWINGS

Some preferred embodiments of the invention will now be described with reference to the accompanying drawings, in which.

DESCRIPTION OF THE PREFERRED EMBODIMENT OF THE INVENTION

Figure 1:
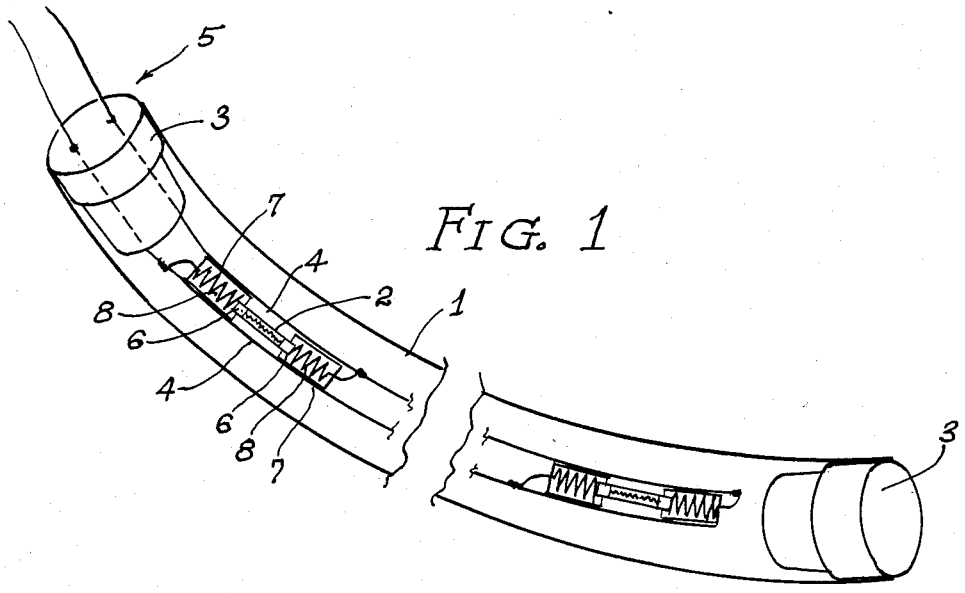
FIG. 1 is a perspective view of the flexible tube containing a string of electric light bulbs.
Figure 2:
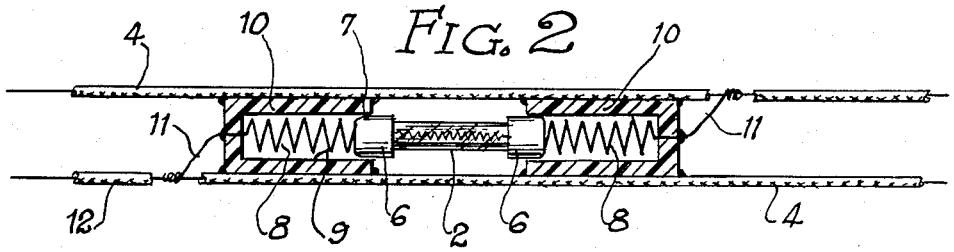
FIG. 2 shows the connection of one of the bulbs to the pair of connecting leads.

FIGS. 1 and 2 show a first embodiment of a strip lighting system according to the present invention.

As shown in FIG. 1, the system basically comprises a flexible tube 1 containing a string of electrically connected small light bulbs 2. Each end of the tube 1 is capped and sealed with a waterproof plug 3. The light bulbs 2 are connected in parallel between a pair of wire leads 4. At one end 5 the leads 4 project out of the tube 1 through small holes in the plug 3 at that end and are connected to a low voltage power source (not shown). The leads 4 have a sealing engagement in the holes in plug 3. The tube is of a transparent or partly transparent plastic material and may be colored, if desired, to add to the ornamental effect of the light shining through it. It may suitably be of vinyl material, for example. The plugs 3 are preferably of rubber or other waterproof material.

FIG. 2 shows the mounting of one of the light bulbs 2 in more detail. The light bulbs are connected in parallel across the leads 4. The light bulbs are of an elongate type having an electrical contact 6 at each end. Each contact 6 projects into an adjacent contact mounting 7. In the preferred embodiment shown in FIG. 2 the contact mountings 7 comprise wire coil springs 8 into which the end of each contact projects. The springs 8 bear against the respective contacts so that electrical contact is maintained even when the string of light bulbs is bent. At the same time a bulb 2 can be replaced when necessary by manually releasing it from the springs 8 holding it in place.

Each spring 8 is mounted in a bore 9 in a rigid cylinder or sleeve 10. The cylinder 10 is suitably of plastic or other nonconducting material. The leads 4 project along opposite sides of the cylinders 10, and are bonded or otherwise attached to them. The inner end 11 of each spring 8 projects out through the wall of its cylinder 10 and is soldered or otherwise connected to one of the wire leads 4. For each light bulb, one of the springs 8 is connected to one of the wire leads and the other spring is connected to the other lead, as shown in FIG. 2. Thus the bulb is connected across the leads. The wire leads are mounted in insulating sleeves 12 but are exposed in the regions where they are connected to the ends 11 of the springs 8.

Thus even if the sleeves 10 are bent relative to the light bulb 2 mounted between them, the contacts 6 will still be held within the respective springs 8 and electrical contact will be maintained.

The string of light bulbs can be readily inserted in or removed from the tube 1, and once in position as shown in FIG. 1 provides a flexible and substantially waterproof strip lighting system. The light bulbs are small, low power light bulbs. In one example a 300' to 400' length of the strip lighting system with 3 watt bulbs separated by about 18" was run from a 24 volt battery.

Thus the system has a relatively low power consumption and can be run off a rechargeable battery. It is therefore safe and economical to use. For emergency operation the system can be run from a car cigarette lighter.

Figure 3:
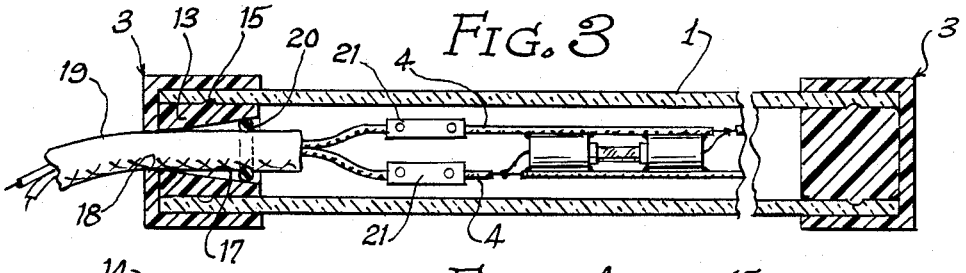
FIG. 3 shows a cross-sectional view of another embodiment of the strip lighting system of the invention.
Figure 4:
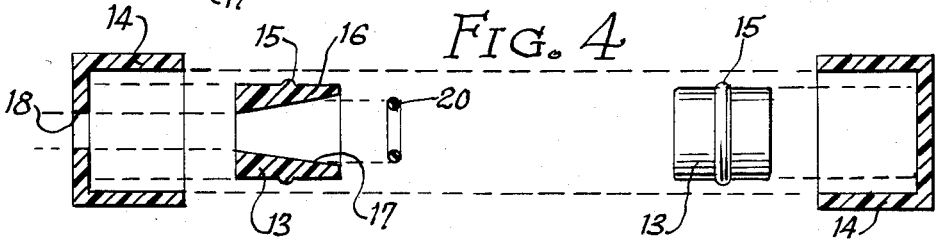
FIG. 4 shows the end plugs of FIG. 3 in more detail.

FIGS. 3 and 4 show another embodiment of the invention where the tube 1 and string of light bulbs are the same as in the first embodiment and are given like reference numbers, but the plugs 3 sealing the ends of the tube are modified.

In FIGS. 3 and 4 each end plug 3 is in two parts, comprising an insert 13 and an end cap 14. The insert 13 at each end has an outer rib or bead 15 and is shaped to have a sealing force fit in the end of the tube. The end caps 14 are force fit over the ends of the tube to form a further seal.

At one end insert 13 comprises a sleeve 16 having a tapered inner bore 17, and the end cap 14 has a central opening 18 aligned with the bore 17. The leads 4 at that end project out of the end plug 3 inside a protective sleeve or cable 19 through the bore 17 and opening 18. An O-ring seal 20 is mounted on the sleeve 19 in the tapered bore 17. The diameter of the sleeve 19 is such that it forms a seal when urged out through the opening 18. When the sleeve or cable 19 and leads 4 are pulled out of the tube, the O-ring seal 20 is forced against the tapered surface of the bore 17 to produce a sealing engagement.

The insert 13 at the other end of the tube is a cylindrical plug having a rib or bead 15 to form a seal when it is force fit in the end of the tube 1. The tube 1 may have dimples or grooves at each end into which the ribs 15 fit in order to hold the inserts 14 in place. End cap 14 is force fit over the end of the tube 1.

The wire leads 4, bulbs, and bulb mountings in the embodiment shown in FIGS. 3 and 4 are as shown in FIG. 2. The leads 4 are each connected to a terminal block 21 before projecting out of the end of the tube in the sleeve or insulating cable 19.

The inserts 13 and end caps 14 may be of any suitable water resistant material such as rubber or plastics. Thus the second embodiment is extremely waterproof and can be used underwater, for example for underwater illumination of swimming pools.

Figure 5:
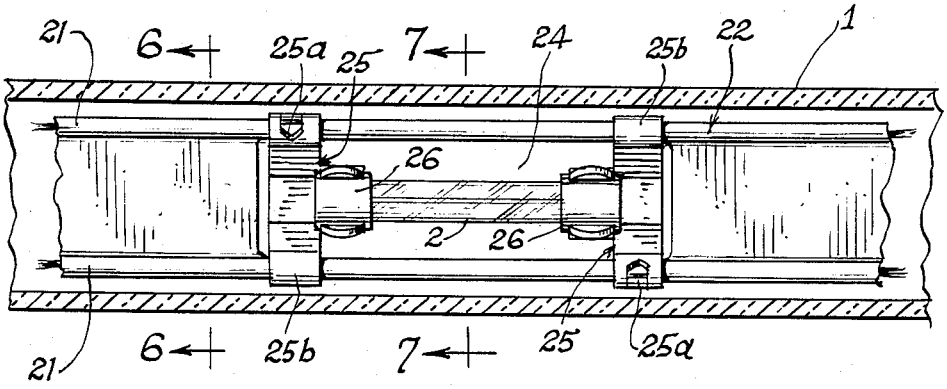
FIG. 5 illustrates an alternative means of constructing the string of bulbs.

A somewhat less rigid but also less expensive method of constructing the string of lights contained within the protective tubing is illustrated in FIG. 5. In this embodiment the electrical leads 21 are contained within common twin-lead wire 22 which is supplied with a plasticized webbing material connecting the parallel insulated wires. A lengthwise or oval shaped hole 24 is stamped in the webbing material at spaced intervals in order that the bulb can be mounted at each interval. At each end of the stamped hole a metal bridge 25 can be crimped or stamped onto the wire across the leads, one end 25*a* containing a stamped sharp prong to pierce the wire to make electrical contact, and the other ends 25*b* without such piercing contact to merely clamp and hold the wire. Each metal bridge further forms an extension 26 which is bent to form a U-shaped clip into which the bulb can be clamped in a standard manner. The pair of metal bridges clamped onto the twin-lead wire provides the electrical connections for current flow between the two wires and through the bulb while at the same time forming a flexible holder for the bulb itself. The entire operation in this embodiment of construction of the string of bulbs thus can be accomplished by a automated stamping operation reducing costs. As assembled the string can be easily threaded into the outer protective tube 1.

Figure 6:
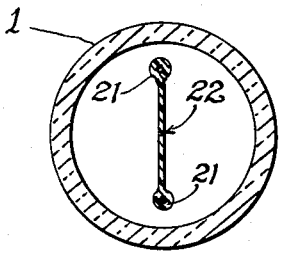
FIG. 6 is a cross-section along line 6—6 of FIG. 5 of the alternative string embodiment.
Figure 7:
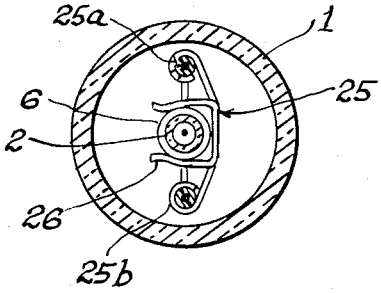
FIG. 7 is a cross-section along lines 7—7 of the alternative embodiment.

FIG. 6 illustrates in cross-section how the twin-lead wire 22 is contained within the outer tubing 1 with room to allow flexion of the outer tubing. Similarly FIG. 7 illustrates the clearance of the bulb 2 and metal bridge 25 with clip holder 26 contained within tubing 1. In this cross-section the prong 25*a* at the upper wire connection can be seen penetrating the wire insulation to make contact with the electrical conductor and the opposite end of the bridge 25*b* can be seen near the clamp around the insulated wire for support without piercing it to make connection.

The strip lighting system described in the above embodiments can be used in a wide variety of applications. It can be used for outdoor ornamental illumination of buildings or garden areas, for example. To illuminate a building, a series of metallic J-bracket hangers may be secured at spaced intervals along the eaves, for example, and a tube can be simply hung in the J-bracket hangers. The hangers may be of galvanized wire mesh. With this system it is easy to take down the tube if it is to be repaired or replaced.

The lighting system is sufficiently waterproof for outdoor use, and is sturdy and hardwearing. As well as the ornamental uses described above, it has a wide variety of practical applications. It can be used, for example, to illuminate scaffolding, building sites, roadworks, or other outdoor structures. It can be used in place of flares by the police in controlling traffic. The lighting strip is so sturdy that it can be run over by vehicles with little or no damage, and can be quickly placed around the area of an accident for example. Unlike flares, it leaves no debris in the road.

Other possible uses include port and starboard lighting on boats, lighting of farm buildings such as greenhouses which need constant low-power light, and illumination of the holds of ships during inspections. In the latter case the low power, battery operation of the system makes it safe for use even in areas where explosive gases may be present.

Further the low power low voltage operation of the system is low enough to run the system by a battery power supply for long periods of time, an important feature in outdoor application, not only because it may be adaptable to application where no line voltage connection is available, but because of the low power operation is safer than system which carry normal 110 or 220 line voltage. Workmans' safety in mounting, maintaining and repairing systems in locations of difficult access such as roofline decorative applications for commercial buildings is an imperative improvement over high voltage systems in current use.

Thus the strip lighting system of this invention is versatile, economical and sturdy and can be used in many outdoor and indoor applications.

It will be appreciated that modification can be made to the preferred embodiments described above without departing from the scope of the invention. The scope of the invention is therefore not limited to the above described embodiment but is defined in the appended claims.

We claim:

1. A strip lighting system comprising a flexible tube of waterproof material, a string of electrically connected light bulbs contained within said tube and spaced from the wall of the tube to allow flexing of the tube;

means for releasably sealing each end of the tube, means for connecting said string of light bulbs to an electrical power source;

a pair of wire leads extending in parallel along the length of the tube;

means for releasably connecting the light bulbs separately at spaced intervals in parallel across the wire leads, each light bulb being elongate and having an electrical contact at each end;

each light bulb connecting means comprising contact mounting means or releasably receiving opposite ends of a light bulb, and means for electrically connecting one of said mounting means to one of said wire leads and the other of said mounting means to the other wire lead.

2. The system of claim 1, wherein each contact mounting comprises a coil spring, a respective light bulb contact being seated within the coil of said spring, one spring of each pair being connected to one of said leads and the other spring being connected to the other lead.

3. The system of claim 2, wherein each contact mounting includes a cylinder having a bore at one end in which a respective spring is mounted, said spring bearing against the inner end of said bore at one end and a respective light bulb at the other end, a free end of said spring projecting out of a wall of said cylinder and being connected to a respective one of said leads.

4. The system of claim 3, wherein said leads are attached to opposed positions on each of said cylinders.

5. The system of claim 1, wherein the means for sealing each end of the tube comprises a removable plug.

6. The system of claim 1, wherein the means for sealing each end of the tube comprises an insert for sealing engagement in the end of the tube and a end cap for sealing engagement over the end of the tube.

7. The system of claim 1 wherein the pair of wires leads further comprises a twin lead wire with flexible webbing material connecting the twin leads along it length and containing spaced openings along it length.

8. The system of claim 7 wherein the contact mounting means is a pair of metal bands placed athwart the twin lead wires, one metal band having a piercing contact means connected to one wire and the other metal band having a piercing contact means connected to the other wire, and each metal band having a clamp bulb holder formed by an extension of the metal clamp at the center of the metal band.

9. A strip lighting system comprising a flexible tube of waterproof material, and string of electrically connected light bulbs contained within the tube;

a pair of wire leads extending in parallel within and along the length of the tube;

means for releasably connecting each light bulb separately in parallel along the length of the tube;

each light bulb being elongate and having an electrical contact at each end;

each light bulb connecting means comprising contact mounting means for releasably receiving opposite ends of a light bulb, and means for electrically connecting one of said mounting means to one of said wire leads and the other of said mounting means to the other of said wire leads;

means for releasably sealing a first end of the tube comprising an insert for sealing engagement in the end of the tube and an end cap for sealing engagement over the end of the tube;

means for releasably sealing the second end of the tube comprising an insert sleeve for sealing engagement in the end of the tube and an end cap for sealing engagement over the end of the tube, the sleeve having a tapered inner bore and the end cap having an opening aligned with the narrowest end of the bore;

a protective cable enclosing the wire leads at the second end of the tube;

the cable and leads projecting out of the second end of the tube through the sleeve and end cap for connection to a source of electrical power; and an O-ring seal mounted on the cable in the tapered bore of the sleeve for forming a seal against the tapered surface of the bore when the cable is pulled out of the tube.

10. A strip lighting system comprising a flexible tube of waterproof material;

a string of electrically connected light bulbs contained within the tube;

means for releasably sealing each end of the tube;

means for electrically connecting the string of light bulbs to an electrical power source;

the string of light bulbs including a pair of wire leads extending in parallel along the tube, and means for electrically connecting each light bulb in parallel across the wire leads;

each light bulb being elongate and having an electrical contact at each end;

the wire leads comprising a twin lead wire with flexible webbing material connecting the twin leads along its length, the webbing material having spaced openings along its length equal to the length of a light bulb;

the light bulb connecting means comprising contact mounting means for releasably mounting each light bulb in a respective opening;

the contact mounting means comprising a pair of metal bands placed athwart the twin lead wires, one metal band having a piercing contact means connected to one wire and the other metal band having a piercing contact means connected to the other wire, and each metal band having a clamp bulb holder formed by an extension of the metal clamp at the center of the metal band.

* * * * *